US006978559B2

(12) United States Patent
Chu et al.

(10) Patent No.: US 6,978,559 B2
(45) Date of Patent: Dec. 27, 2005

(54) LINING OF FOOTWEAR HAVING FUNCTIONS OF VENTILATION AND WATERPROOF

(75) Inventors: Fu-Kuo Chu, Taichung Hsien (TW); Chin-Tai Liu, Taichung Hsien (TW)

(73) Assignee: Tiong Liong Industrial Co., Ltd., Taichung Hsien (TW)

( * ) Notice: Subject to any disclaimer, the term of this patent is extended or adjusted under 35 U.S.C. 154(b) by 17 days.

(21) Appl. No.: 10/790,721

(22) Filed: Mar. 3, 2004

(65) Prior Publication Data

US 2005/0193593 A1 Sep. 8, 2005

(51) Int. Cl.[7] ..... A43B 23/07
(52) U.S. Cl. ..... 36/55; 36/14
(58) Field of Search ..... 36/55, 14, 12; 12/142 RS, 142 T

(56) References Cited

U.S. PATENT DOCUMENTS 1,920,338 A * 8/1933 Ayers ..... 36/16
2,446,357 A * 8/1948 Vigorith ..... 36/19 A
5,933,896 A * 8/1999 Gallina ..... 12/142 P

* cited by examiner

*Primary Examiner*—Ted Kavanaugh
(74) *Attorney, Agent, or Firm*—Bacon & Thomas PLLC

(57) ABSTRACT

A lining has a vamp member, a sole member and an inner sole. The vamp member is stitched to the body portion of the sole member directly. The vamp member further has a periphery portion bent inwards under and attached on a bottom side of the sole member at where a portion of the sole member is adapt to bear a heel portion of the foot thereon. The inner sole has a portion attached on a bottom side of the sole member and a periphery portion attached on the vamp member via a glue layer. The inner sole has a waterproof and ventilation layer and two non-weave fabrics attached on the opposite sides respectively.

5 Claims, 5 Drawing Sheets

LINING OF FOOTWEAR HAVING FUNCTIONS OF VENTILATION AND WATERPROOF

BACKGROUND OF THE INVENTION

1. Field of the Invention

The present invention relates generally to footwear, and more particularly to a lining of a shoe, which is capable of ventilation and waterproof.

2. Description of the Related Art

There were many waterproof shoes in the market and these shoes usually are provided with a waterproof lining. The conventional lining has a vamp member and a sole member stitched together and coated with a layer of glue on a bottom side of the sole member. There are two kind of the glue be used in this art. The first kind of the glue layer provides the function of waterproof, but it also makes the sole member harder and having no capacity of ventilation. There was a lining coated with a layer of the second kind of softer glue. Such glue is softer to make the sole member more flexible and ventilated, but it has no capacity of waterproof.

SUMMARY OF THE INVENTION

The primary objective of the present invention is to provide a lining of footwear, which provides both functions of ventilation and waterproof.

According to the objective of the present invention, a lining comprises a vamp member, a sole member and an inner sole. The sole member is stitched to the vamp member directly at a front section and a middle section thereof. The vamp member has a periphery portion bent inwards and attached on a bottom side of the sole member at a rear section thereof. The inner sole has a portion attached on a bottom side of the sole member and a periphery portion attached on the vamp member via a glue layer. The inner sole is bent at where the vamp member is coupled with the sole member. The inner sole has a waterproof and ventilation layer.

DETAILED DESCRIPTION OF THE INVENTION

As shown in FIGS, from FIG. 1 to FIG. 5, a lining of the preferred embodiment of the present invention comprises:

A vamp member 10 is made of fabric, leather, synthetic fiber or synthetic leather and so on.

A sole member 20 has a body portion 21 and a heel portion 22. The body portion 21 is the front and middle section of the sole member 20 adapted to bear toes, a sole portion and an arch portion of a foot thereon and the heel portion 22 is the rear section thereof to bear the heel of the foot thereon. The body portion 21 has an edge portion stitched with the vamp member 10 directly. The heel portion 22 is the rear section of the sole member 20 and is wider than the body portion 21. The vamp member 10 has a periphery portion bent inwards under and stuck on a bottom side of the heel portion 22.

Figure 1:
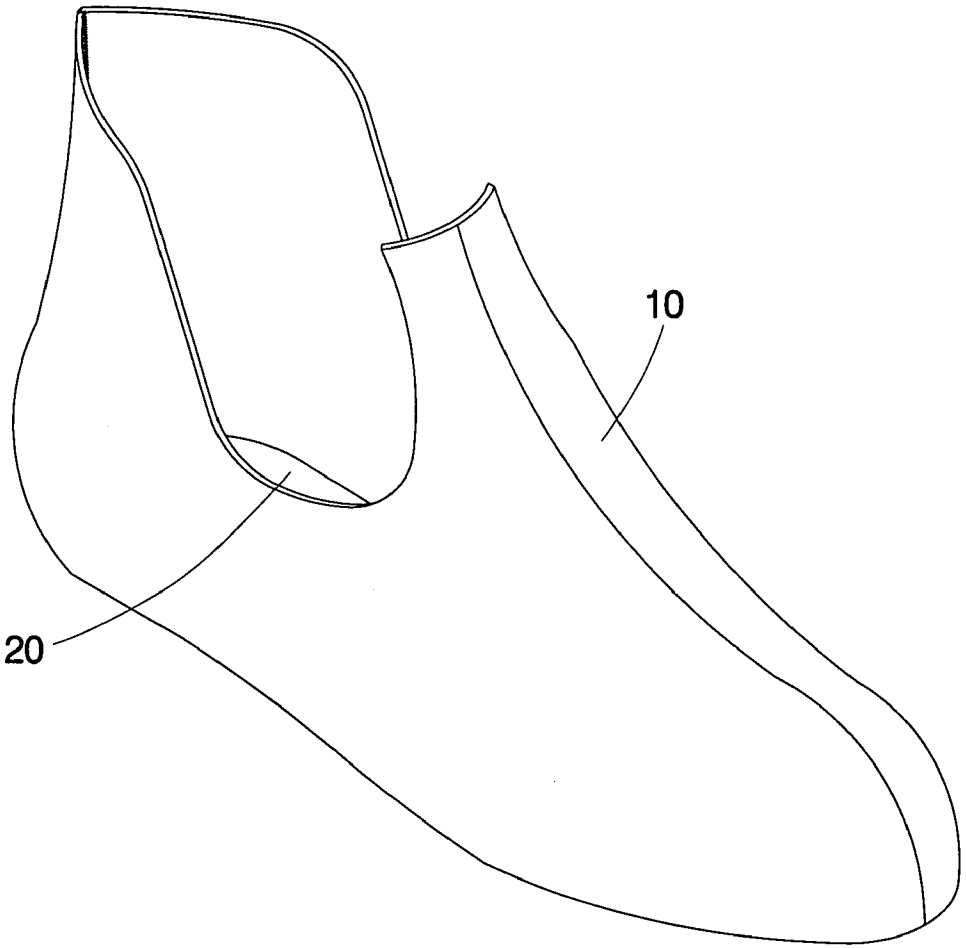
FIG. 1 is a perspective view of a preferred embodiment of the present invention.
Figure 2:
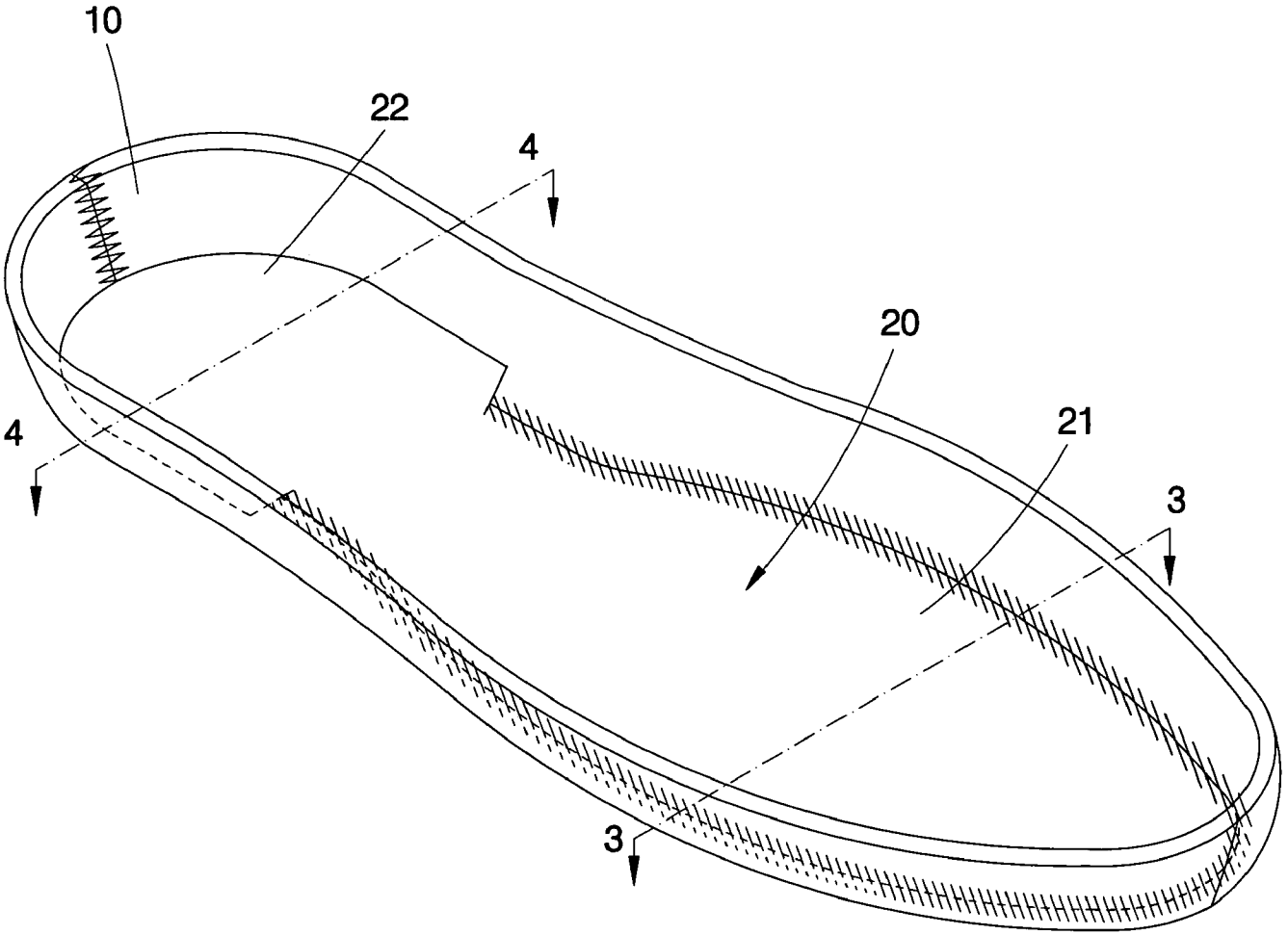
FIG. 2 is a top view of the preferred embodiment of the present invention.
Figure 3:
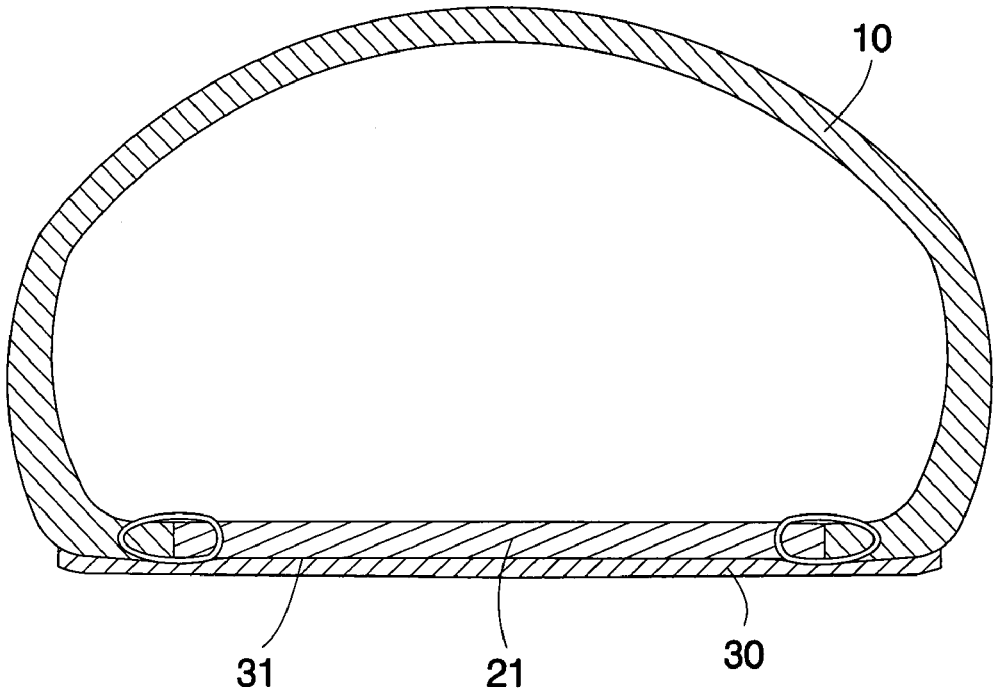
FIG. 3 is a sectional view along the 3—3 line of FIG. 2.
Figure 4:
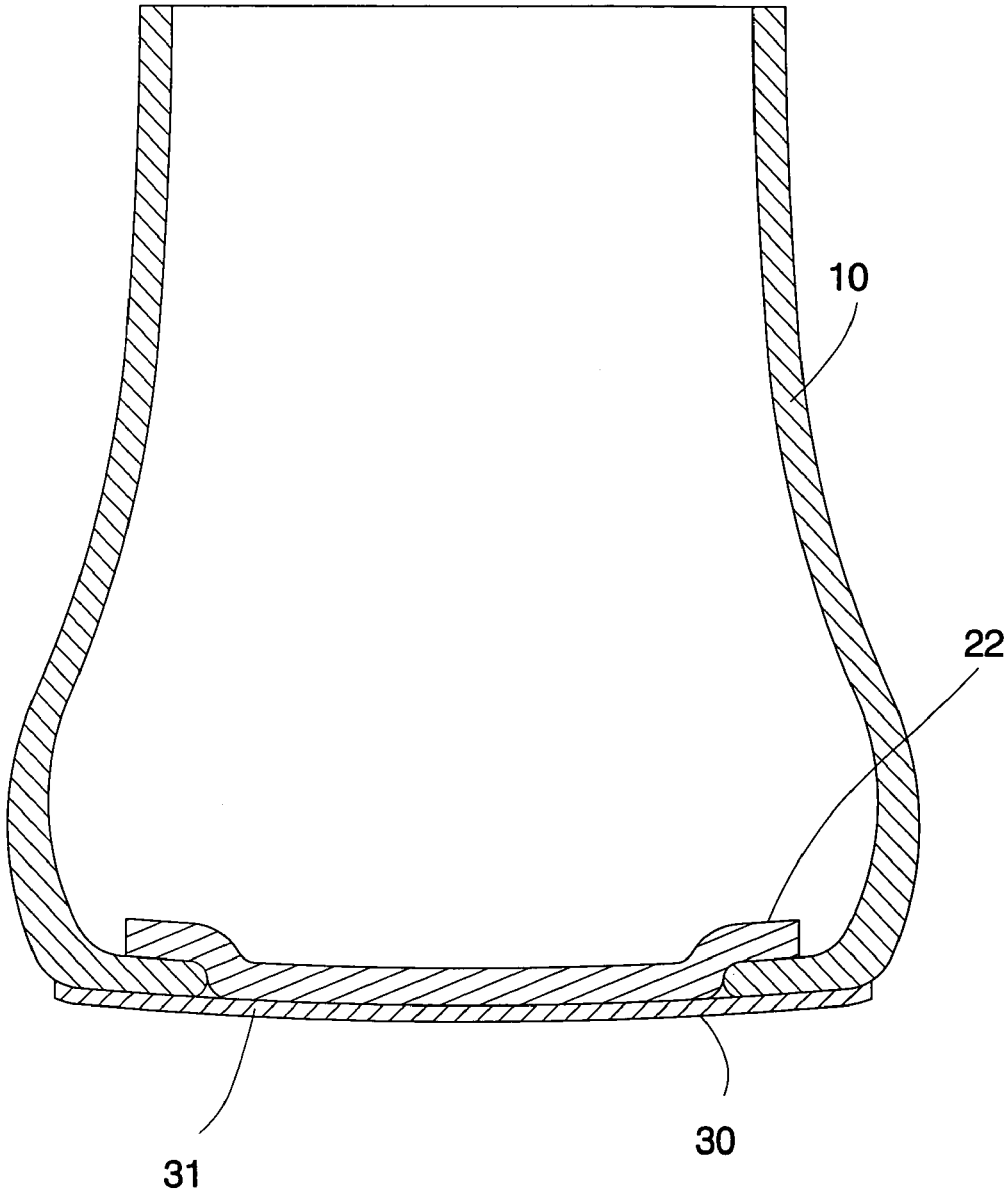
FIG. 4 is a sectional view along the 4—4 line of FIG. 2.
Figure 5:
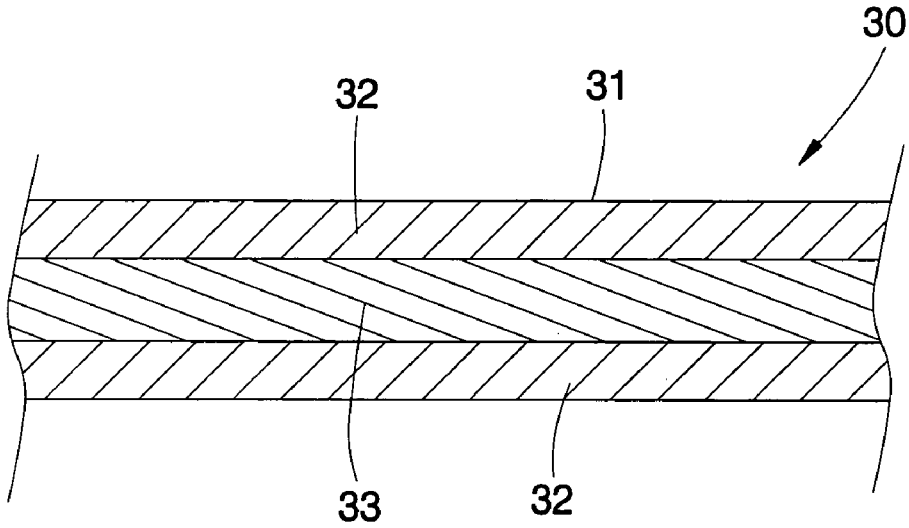
FIG. 5 is a sectional view in a part of the inner sole.

An inner sole 30 has a shape similar to a foot and has a size greater than the sole member 20. The inner sole 30 has a portion stuck on a bottom side of the sole member 20 and a periphery portion stuck on the vamp member 10 via a glue layer 31. The inner sole 30 is inserted at where the sole member 20 coupled with the vamp member 10. The inner sole 30 has a non-weave fabric layer 32 and a waterproof and ventilation layer 33. As shown in FIG. 5, the present preferred embodiment provides the inner sole 30 consisted a plastic layer as the waterproof and ventilation layer 33 and two non-weave fabric layers 32 attached on opposite sides of the waterproof and ventilation layer 33.

The present invention provides the waterproof and ventilation layer 33 on the inner sole 30 such that the glue layer 31 can be chosen from glue, which is softer and ventilated but not waterproof, and the lining of the present invention still serves both functions of waterproof and ventilation. In addition, the vamp member is bent inwards and stuck on the bottom side of the heel portion of the sole member to replace the conventional lining having the vamp member stitched with the sole member directly. The conventional lining usually has the stitching portion of the sole member and the vamp member damaged after a long time of wearing. The present invention provides user having the heel of the foot standing on the heel portion of sole member rather than the stitching portion of the sole member and the vamp member. It makes the lining of the present invention has a firmly condition of sole member coupled with the vamp member, even if user has wore the lining of the lining of the present invention for a long time.

What is claimed is:

1. A lining of a footwear, comprising:

a vamp member;

a sole member having a front section, which corresponds to toes and a sole portion of the foot, a middle section, which corresponds to an arch portion of the foot, and a rear section, which corresponds to a heel portion of the foot, wherein the sole member has an edge portion of the front section and the middle section stitched to the vamp member directly and the vamp member has a periphery portion bent inwards under and attached on a bottom side of the sole member, and an inner sole having a portion attached on a bottom side of the sole member and a periphery portion attached on the vamp member via a glue layer and the inner sole inserted at where the vamp member is coupled with the sole member, wherein the inner sole has a waterproof and ventilation layer.

2. The liner as defined in claim 1, wherein the inner sole further has a non-weave fabric layer.

3. The lining as defined in claim 1, wherein the inner sole further has two non-weave fabric layers attached on opposite sides of the waterproof and ventilation layer respectively.

4. The lining as defined in claim 1, wherein the sole member has a body portion, which an edge portion is stitched with the vamp member, and a heel portion, which is wider than the body portion, and the vamp member is bent inwards under and attached on a bottom side of the heel portion.

5. The lining as defined in claim 1, wherein the glue layer is ventilated but not waterproof.

* * * * *